US007805227B2

(12) United States Patent
Welles et al.

(10) Patent No.: US 7,805,227 B2
(45) Date of Patent: Sep. 28, 2010

(54) APPARATUS AND METHOD FOR LOCATING ASSETS WITHIN A RAIL YARD

(75) Inventors: Kenneth Brakeley Welles, Scotia, NY (US); Rahul Bhotika, Niskayuna, NY (US); David Michael Davenport, Niskayuna, NY (US); John Erik Hershey, Ballston Lake, NY (US); Robert James Mitchell, Waterford, NY (US); Emad Andarawis Andarawis, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 1313 days.

(21) Appl. No.: 11/318,338

(22) Filed: Dec. 23, 2005

(65) Prior Publication Data

US 2007/0150130 A1 Jun. 28, 2007

(51) Int. Cl.
*G05D 1/00* (2006.01)
*G05D 3/00* (2006.01)

(52) U.S. Cl. ..... 701/19; 246/122 R; 246/123; 246/108; 702/5

(58) Field of Classification Search ..... 701/19; 246/122 R, 123, 108; 702/5
See application file for complete search history.

(56) References Cited

U.S. PATENT DOCUMENTS 4,520,662 A 6/1985 Schmid ..... 79/129
4,838,173 A 6/1989 Schroeder et al. ..... 105/35
5,124,915 A * 6/1992 Krenzel ..... 702/5
5,481,479 A * 1/1996 Wight et al. ..... 701/223

(Continued)

FOREIGN PATENT DOCUMENTS

JP 11039031 A * 2/1999

(Continued)

OTHER PUBLICATIONS

Wireless communications based system to monitor performance of rail vehicles; Nejikovsky, B. et al.; Railroad Conference, 2000. Proceedings of the 2000 ASME/IEEE Joint ; Digital Object Identifier: 10.1109/RRCON.2000.869993; Publication Year: 2000 , pp. 111-124.*

(Continued)

*Primary Examiner*—Cuong H Nguyen
(74) *Attorney, Agent, or Firm*—Jason K. Klindtworth

(57) ABSTRACT

A method for tracking assets within a rail yard, the method comprising: creating a track layout database for the rail yard, the track layout database providing a map of rail tracks and switches within the rail yard, wherein the track layout database includes machine readable data identifying discrete locations of the rail tracks and switches of the rail yard, each discrete location corresponding to a geographical position of a portion of a rail track or switch; associating rail yard processing steps with portions of the track layout database; receiving a geographical position signal corresponding to an asset within the rail yard; comparing the geographical position signal to the machine readable data of the track layout database in order to identify the location of the asset within the map; and presenting a graphical representation of the location of the asset on the map along with the yard process steps associated with the track section occupied by the asset, wherein the geographical position signal is received within a time period to allow the graphical presentation to be used in a management decision corresponding to the asset.

28 Claims, 4 Drawing Sheets

U.S. PATENT DOCUMENTS

| | | | | |
|---|---|---|---|---|
| 5,586,669 | A | 12/1996 | Seay et al. | 213/43 |
| 5,735,491 | A | 4/1998 | Atkinson | 246/124 |
| 5,950,967 | A | 9/1999 | Montgomery | 246/182 |
| 6,206,215 | B1 | 3/2001 | Maa | 213/75 |
| 6,377,877 | B1 | 4/2002 | Doner | 701/19 |
| 6,405,127 | B1 | 6/2002 | Doner | 701/207 |
| 6,637,703 | B2 | 10/2003 | Matheson et al. | 246/124 |
| 7,188,057 | B2 * | 3/2007 | Birkelbach et al. | 703/7 |
| 2002/0084387 | A1 * | 7/2002 | Matheson et al. | 246/124 |
| 2003/0182030 | A1 | 9/2003 | Kraeling et al. | 701/19 |
| 2004/0102878 | A1 * | 5/2004 | Hawthorne | 701/19 |
| 2004/0138789 | A1 * | 7/2004 | Hawthorne | 701/19 |
| 2005/0035862 | A1 * | 2/2005 | Wildman et al. | 340/573.1 |
| 2005/0209770 | A1 * | 9/2005 | O'Neill et al. | 701/117 |
| 2005/0242052 | A1 * | 11/2005 | O'Connor et al. | 212/344 |
| 2006/0167728 | A1 * | 7/2006 | Siegel et al. | 705/7 |
| 2007/0024468 | A1 * | 2/2007 | Quandel et al. | 340/968 |
| 2007/0150130 | A1 * | 6/2007 | Welles et al. | 701/19 |
| 2007/0247316 | A1 * | 10/2007 | Wildman et al. | 340/572.4 |
| 2008/0062262 | A1 * | 3/2008 | Perron et al. | 348/82 |
| 2008/0252527 | A1 * | 10/2008 | Garcia | 342/450 |
| 2009/0252302 | A1 * | 10/2009 | Monroe | 379/37 |

FOREIGN PATENT DOCUMENTS

| | | | | |
|---|---|---|---|---|
| JP | 2000047577 | A | * | 2/2000 |
| KR | 20040092508 | A | * | 11/2004 |
| WO | WO 01/26059 | | * | 4/2001 |
| WO | WO 2005/119630 | A | * | 12/2005 |

OTHER PUBLICATIONS

The Rail Yard Manager; Lewellen, M. et al.; Tools with Artificial Intelligence, 1994. Proceedings., Sixth International Conference on; Digital Object Identifier: 10.1109/TAI.1994.346506; Publication Year: 1994 , pp. 112-119.*

YardSim: A rail yard simulation framework and its implementation in a major railroad in the U.S.; Lin, E. et al.; Winter Simulation Conference (WSC), Proceedings of the 2009; Digital Object Identifier: 10.1109/WSC.2009.5429654; Publication Year: 2009 , pp. 2532-2541.*

Design and Simulation of a Conceptual Automated Yard using New Combination System; Hong-Fa Ho et al.;SICE-ICASe, 2006. International Joint Conference; Digital Object Identifier: 10.1109/SICE.2006.315793; Publication Year: 2006 , pp. 375-380.*

Solving a multimodal transport problem by DCA; Le Thi, H.A.; Ndiaye, B.M.; Tao Pham Dinh; Research, Innovation and Vision for the Future, 2008. RIVF 2008. IEEE International Conference on; Digital Object Identifier: 10.1109/RIVF.2008.4586332 Publication Year: 2008 , pp. 49-56.*

An Effective Heuristic for the Integrated Scheduling Problem of Automated Container Handling System Using Twin 40' Cranes Kewei Zheng; Zhicliang Lu; Xiaoming Sun; Computer Modeling and Simulation, 2010. ICCMS '10. Second International Conference on; vol. 1; Digital Object Identifier: 10.1109/ICCMS.2010.290; Publication Year: 2010 , pp. 4.*

Simulation of Queensland coal rail operations; Eustace, C.M.; Simulation Conference, 2008. WSC 2008. Winter Digital Object Identifier: 10.1109/WSC.2008.4736428; Publication Year: 2008 , pp. 2938-2938.*

Towards an integrated modeling and simulation framework for freight transportation in metropolitan areas; Qunzhi Zhou et al.; Information Reuse and Integration, 2008. IRI 2008. IEEE International Conference on; Digital Object Identifier: 10.1109/IRI.2008.4583043; Publication Year: 2008 , pp. 280.*

* cited by examiner

APPARATUS AND METHOD FOR LOCATING ASSETS WITHIN A RAIL YARD

BACKGROUND

This invention relates generally to rail yards, and more particularly to determining the location of rolling stock, including railcars and locomotives, within a rail yard.

Rail yards are the hubs of railroad transportation systems. Therefore, rail yards perform many services, for example, freight origination, interchange and termination, locomotive storage and maintenance, assembly and inspection of new trains, servicing of trains running through the facility, inspection and maintenance of railcars, and railcar storage. The various services in a rail yard compete for resources such as personnel, equipment, and space in various facilities so that managing the entire rail yard efficiently is a complex operation.

The railroads in general recognize that yard management tasks would benefit from the use of management tools based on optimization principles. Such tools use a current yard status and a list of tasks to be accomplished to determine an optimum order in which to accomplish these tasks.

However, any management system relies on credible and timely data concerning the present state of the system under management. In most rail yards, the current data entry technology is a mixture of manual and automated methods. For example, automated equipment identification (AEI) readers and AEI computers determine the location of rolling stock at points in the sequence of operations, but in general, this information limits knowledge of rolling stock whereabouts to at most, the moment at which the rolling stock arrived, the moment at which the rolling stock passes the AEI reader. and the moment at which the rolling stock departs.

The location of assets within a rail yard is typically reported using voice radio communications. Point detection approaches such as wheel counters, track circuits, and automatic equipment identification (AEI) tag readers have been used to detect assets at specific, discrete locations on the tracks. Modern remote control systems use GPS and AEI tags to prevent the remote-controlled locomotive from traveling outside the yard limits. Cameras have been deployed throughout rail yards with shared displays to allow rail yard personnel (i.e. yard masters, hump masters, manager of terminal operations) to locate engines and other assets. However, none of these approaches provide a continuous, real-time view as to the location of all rail yard assets of interest.

It is desirable to know where assets are located within a rail yard in real time (e.g., within the last 10 seconds). These assets could be humans (i.e. car inspectors), maintenance of way vehicles, or locomotives for example. For locomotives it is desirable to know what track they are on and at what position on that track they are located.

Most rail yards do not have accurate track location data. Adjacent tracks can be 13.25 feet apart (according to Association of American Railroads Plate C standard) and track location information may not exist, or may be accurate only to several feet. Collection of this track location information using conventional survey methods and techniques can be time consuming, costly, and negatively impact railroad freight operations.

Accordingly, it is desirable to provide a method and apparatus for providing a continuous real-time view of the location of all the rail yard assets of interest and the rail yard processing task they are associated with.

SUMMARY OF THE INVENTION

A method for tracking assets within a rail yard, the method comprising: creating a track layout database for the rail yard, the track layout database providing a map of rail tracks and switches within the rail yard, wherein the track layout database includes machine readable data identifying discrete locations of the rail tracks and switches of the rail yard, each discrete location corresponding to a geographical position of a portion of a rail track or switch; associating rail yard processing steps with portions of the track layout database; receiving a geographical position signal corresponding to an asset within the rail yard; comparing the geographical position signal to the machine readable data of the track layout database in order to identify the location of the asset within the map; and presenting a graphical presentation of the location of the asset on the map along with yard process steps associated with the track section occupied by the asset, wherein the geographical position signal is received within a time period to allow the graphical presentation to be used in a management decision corresponding to the asset.

A system for tracking assets within a rail yard, the system comprising: a track layout database for the rail yard, the track layout database providing a map of rail tracks and switches within the rail yard, wherein the track layout database includes machine readable data identifying discrete locations of the rail tracks and switches of the rail yard, each discrete location corresponding to a geographical position of a portion of a rail track or switch and each portion of a rail track or switch associated with one or more yard process steps performed on or about the rail track or switch; a plurality of positioning devices configured to generate geographical position signals from a plurality of assets within the rail yard; a computer system, configured to receiving and compare the geographical position signals to the machine readable data of the track layout database in order to identify the location of the plurality of assets within the map and present a graphical presentation of the location of the plurality of assets and the yard process steps associated with these locations on the map.

DETAILED DESCRIPTION OF EXEMPLARY EMBODIMENTS OF THE INVENTION

Disclosed herein is a means of creating and using an accurate database of track locations in a rail yard from either aerial photography or Global Position System (GPS) data acquisition (e.g., using a radio-navigation system formed from satellites and ground stations, wherein a GPS receiver measures distance using the travel time of radio signals). In accordance with exemplary embodiments of the present invention, the database can be located in a control room of a rail yard wherein a computer or controller of the system receives data from an asset within the rail yard. The data of the asset is GPS data, which corresponds to its approximate geographical location wherein the received data corresponding to its approximate location is compared to the track database and thereafter a visual display of the asset on computer monitor is provided.

In accordance with exemplary embodiments of the present invention this information is used to locate the asset to a particular track and a position along that track and to identify the current activity of the asset given yard process steps associated with that track. Thereafter, a display will be provided wherein one or more rail yard operational personnel can use this information to enable planning and decision-making. In accordance with one exemplary embodiment of the present invention, the locations of specific or associated assets (e.g., rail cars), which have been designated to be of high importance can also be identified to the rail yard operations via the graphical display. Reference is made to the following U.S. Pat. Nos. 6,405,127, 6,377,877, 6,637,703; the contents each of which are incorporated herein by reference thereto.

Figure 5:
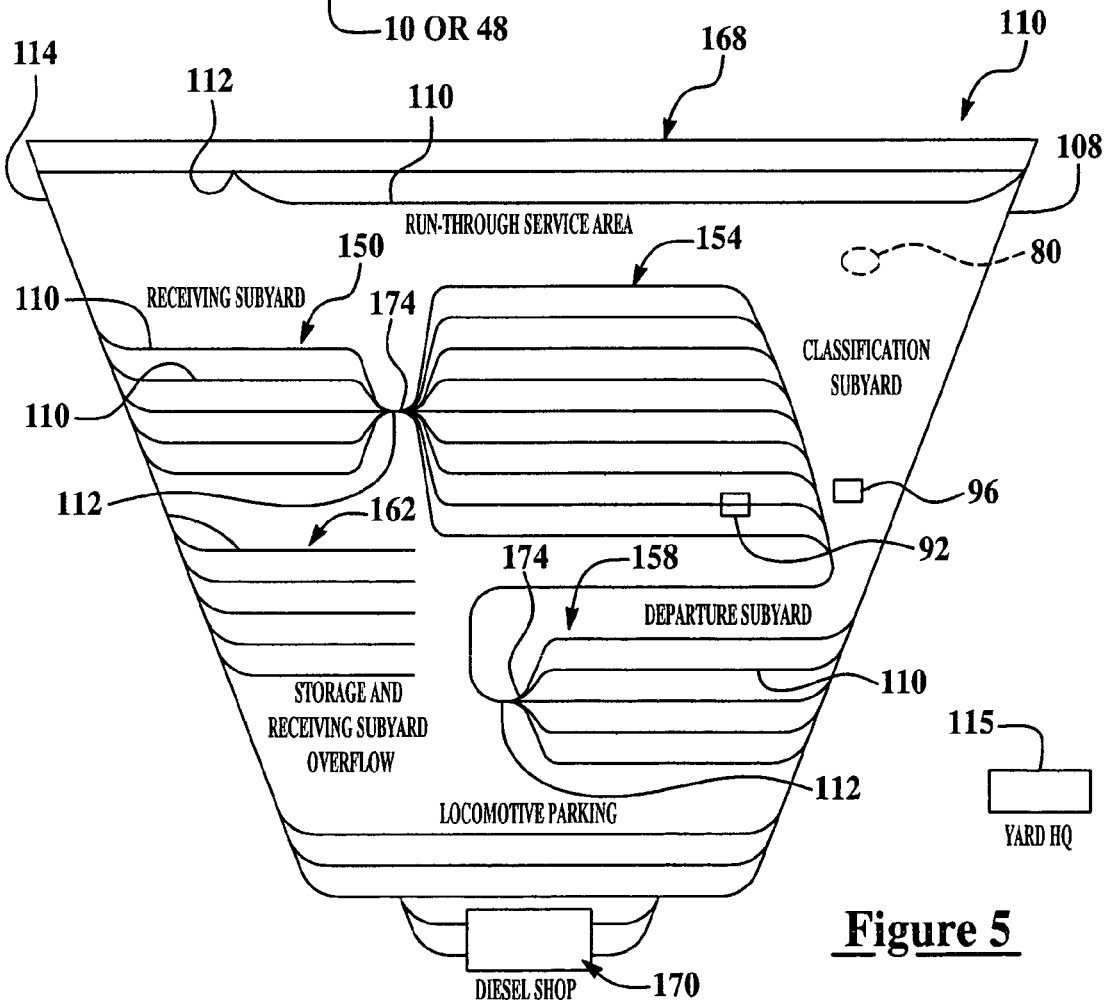
FIG. 5 is generic schematic view of a rail yard.

Exemplary embodiments of the present invention allow for fast, simple and low cost methods of creating an accurate track location database for a rail yard. A generic view of a rail yard is illustrated in FIG. 5. Rail yard 110 illustrates various areas of the rail yard that trains pass through during rail yard processing and are to be detected by the tracking system of exemplary embodiments of the present invention. As illustrated, the rail yard includes various sets of tracks dedicated to specific uses and functions, herein referred to as yard process steps, wherein these functions are recorded into the rail yard database and wherein a tracking database is created, the tracking database comprising a data tracking history for a specific asset; and the data tracking history is used to assign the specific asset to one specific rail track or area.

One non-limiting example of such processes is illustrated as follows: an incoming train arrives in a receiving subyard 150 and is assigned a specific receiving track. At some later time, a switch engine or yard engine enters the receiving track and moves the railcars into a classification subyard 154. Classification subyard 154 is sometimes referred to as a "bowl". The tracks in classification subyard 154 are assigned to hold specific blocks of railcars being assembled for outbound trains. When assembly of a block of railcars is completed, this block of railcars is assigned to a specific track in a departure subyard 158 reserved for assembling a specific outgoing train.

When all blocks of railcars required for an outgoing train are assembled, one or more locomotives from a locomotive storage and receiving overflow subyard 162 will be moved and coupled to the assembled railcars. Rail yard 110 also includes a run-through service area 168 for servicing railcars, and a diesel shop and service area 170 to service and repair locomotives. The organization of the rail yard normally includes a number of throats, or bottlenecks 174, through which all cars involved in the foregoing train assembly process must pass. Bottlenecks 174 limit the amount of parallel processing possible in a yard, and limit the rate at which the sequence of train assembly tasks may occur.

A non-limiting example of one process in the yard is as follows; an incoming train comes to a stop within a receiving subyard of the rail yard and an inbound inspection of the railcars is performed. Thereafter, preparations are made to "hump" the railcars, and then the railcars are then "humped". As used herein "humping" refers to the process of classifying railcars by pushing them over a hill or summit (known as a 'hump'), beyond which the cars are propelled by gravity and switched to any of a plurality of individual tracks in a bowl. The bowl may also be referred to as classification subyard 154. By way of example, humping may involve separating a first railcar from a second railcar, and pushing the first railcar over a hill or summit (known as a 'hump'), beyond which the first railcar is propelled by gravity and switched to a first track in classification subyard 154. The second railcar is separated from any remaining railcars in the plurality of railcars, pushed over the hump, propelled by gravity, and switched to a second track in classification subyard 154. While the primary embodiment refers to a classification process which uses a hump to separate rail cars, other embodiments are applicable to rail yards which do not employ a hump, which are so-called flat yards.

Once the railcars are classified, some railcars may optionally be trimmed or re-humped. Trimming refers to the movement or relocation of a rail car among the classification subyard tracks. After the railcars are classified and any optional trimming or re-humping is performed, the classified railcars are coupled and pulled along classification subyard 154 through bottleneck 174 to departure subyard 158 wherein an outbound inspection of the coupled railcars is performed. Any rail cars which are determined to have mechanical defects which prevent safe operation on the mainline track is removed and placed on a bad order or set out track of the rail yard.

These locomotive processes may be performed before, after, or contemporaneously with the railcar processes wherein the locomotive is transferred into service from locomotive storage and receiving overflow subyard 162. If locomotive service is to be performed, the locomotive is transferred to diesel shop and service are 170. If on the other hand locomotive service is not to be performed, service is bypassed. After locomotive service is performed or bypassed, an outbound locomotive process is performed and the locomotive is transferred to departure subyard 158. The locomotive is then coupled to the processed railcars. The locomotive and processed railcars then depart from the subyard 158 as an outgoing train.

In accordance with an exemplary embodiment, the monitoring system comprises at least a central computer in operable communication with a rail track database and sensors or GPS receivers with associated transmitters to provide real time data of rail yard assets to the central computer for use with the rail track database to provide a visual representation of the assets on a display as they move through the rail yard, which may include various sub yards including but not limited to a receiving yard, a classification yard, a storage and receiving yard, and a departure yard. In accordance with an exemplary embodiment, the present invention employs GPS receivers to provide accurate track placement of locomotives on a status display. Exemplary embodiments provide real-time location of rail yard assets and an indication as to the yard process steps (i.e. tasks) which are conducted on the track occupied by the asset to rail yard personnel in order to enable time-critical decisions to be made relative to task planning, safety and efficiency. For example and in an exemplary embodiment, a yard engine is equipped with a GPS device, wherein the location of the yard engine is continuously transmitted to the central control unit. As used herein GPS device or unit refers to an electronic device that can determine the device's approximate location or coordinates on the planet, wherein the coordinates are given in longitude and latitude and the device itself comprises a means for transmitting these coordinates to the central computer and the computer comprises a means for receiving and interpreting the transmitted coordinates.

Figure 1:
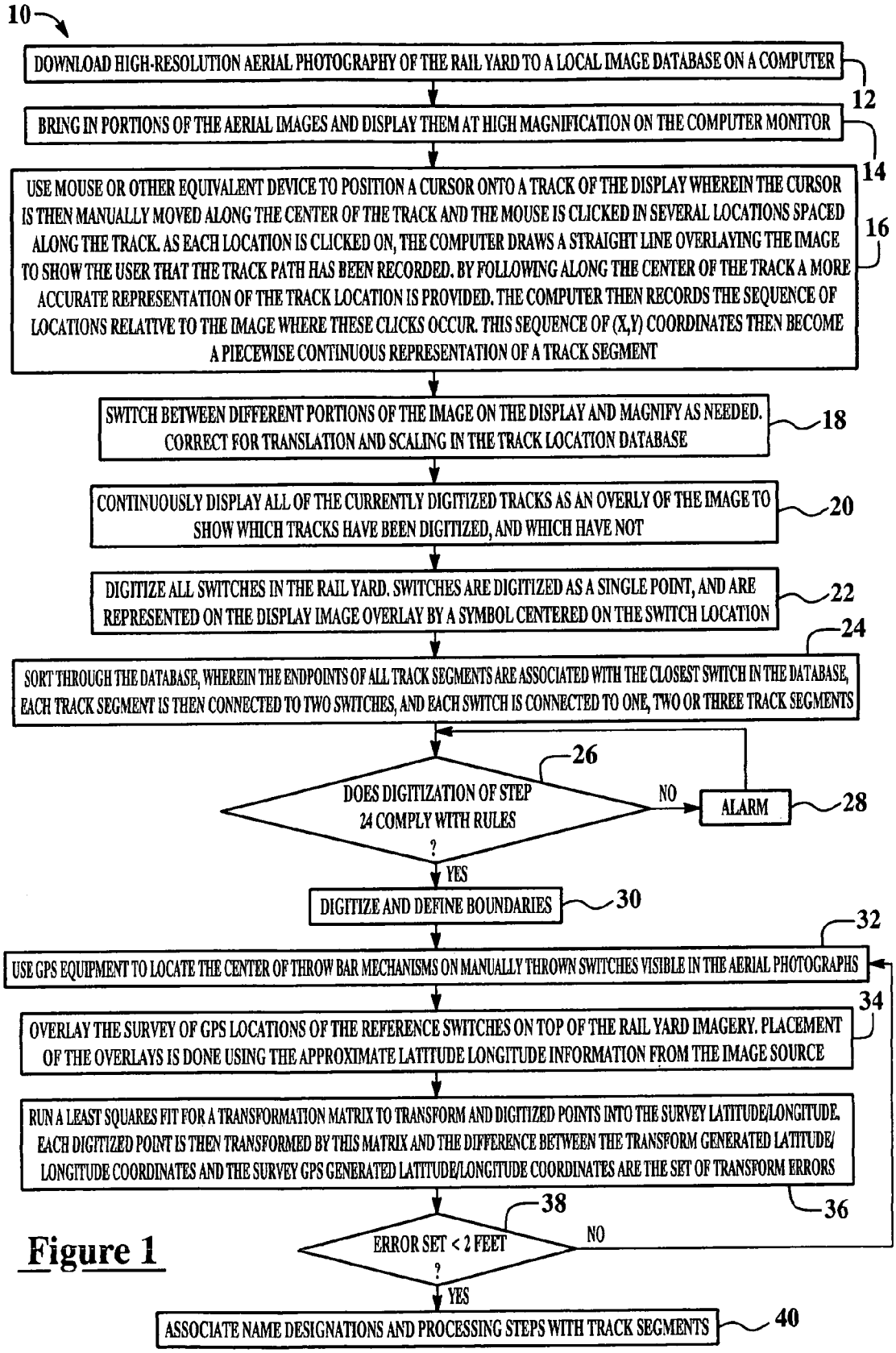
FIG. 1 is a schematic illustration of a method for generating a rail yard track database in accordance with an exemplary embodiment of the present invention.

Referring now to FIG. 1 and in order to create a database from aerial photographs, a program was developed that uses aerial photography to create an accurate database of track, switch, and region locations. If high-resolution aerial photography (i.e. orthoimagery) of the rail yard is available from such sources as the United States Geological Survey (USGS), then images, which cover the entire rail yard at high resolution are downloaded to a local image database on a computer. This is illustrated at box 12. Thereafter at box 14, a computer program then brings in portions of these images and displays them at high magnification on a computer monitor. Thereafter at boxes 16 and 18, the program further allows the use of a mouse or other equivalent device (e.g., touch screen) to position the cursor onto a track on the display. The cursor is then manually moved along the center of the track and the mouse is clicked in several locations spaced along the track. As each location is clicked on, the computer draws a straight line overlaying the image to show the user that the track path has been recorded. By following along the center of the track a more accurate representation of the track location is provided. The computer then records the sequence of locations relative to the image where these clicks occur to provide a sequence of (x,y) coordinates related to the display of the rail yard. This sequence of (x,y) coordinates becomes a piecewise continuous representation of a track segment. A non-limiting example is as follows: a user clicks on the mouse or other equivalent device wherein a graphic user interface provides a prompt of "track segment" or "switch"? If track segment is selected the first location clicked on will be an end point and thereafter each successive point is a portion of the track segment until a last point is selected as the other end point. Thereafter, the user could be prompted to start another track segment or switch. If a switch is selected the user simply clicks once to designate a switch. Another non-limiting example for selecting end points would be to use the "right click" mouse button feature again having a graphic user interface.

In order to accurately digitize a track, the magnification of the image is such that the entire rail yard cannot fit on the screen simultaneously. The program of an exemplary embodiment of the present invention will allow a user to bring different portions of the image onto the display as they are needed, and to switch magnification as needed. The program will also correct for translation and scaling in the track location database (e.g., proper recordation of the (x,y) coordinates or data points as the image is zoomed in and out). The program will also continuously display all of the currently digitized tracks (box 20) as an overlay of the image to show the user which tracks have been digitized, and which have not. Thus, showing progress of the tracks and switches being marked.

In a similar manner and as illustrated by box 22, the user digitizes all switches in the rail yard. Switches are digitized as a single point, and are represented on the display image overlay by a diamond symbol or any other equivalent symbol centered on the switch location. After each session of digitization, the program at step 24 will sort through the database, wherein the endpoints of all track segments are associated with the closest switch in the database. Each track segment is then connected to two switches, and each switch is connected to one, two or three track segments. Any departure from these rules are resolved or alarmed by the program (decision node 26 and step 28). In addition, and at step 24 each track segment endpoint (x,y) locations are replaced by the associated switch (x,y) location. This assures that all tracks and switches connect properly. The relative angles that the three track segments make at a switch are used to classify the three track segments as: Incoming, Outgoing Main and Outgoing Diverted wherein the sharpness of the curve of the track turnout is used to determine the track segment (e.g., the higher the degree of curve the more likely this is an outgoing diverted track segment as opposed to an incoming or an outgoing main). Additional information is found in the following book "The Railroad What It Is, What It Does", 4th edition by John H. Armstrong, Simmons-Boardman Books, Incl, 1998, page 44. As shown in this book track steepness angles are typically in the range of 5 to 20 degrees with 12 degrees being typical for yards and a "Frog Number" is used an industry standard size reference for switches. In other words, a single track lies on one side of a switch while two tracks lie on the opposite side of the switch. The Outgoing Diverted track is that track of the two that makes a larger angle with respect to the projected extension of the incoming track. The Outgoing Main track is that track which makes the smallest angle with respect to the projected extension of the incoming track.

In accordance with an exemplary embodiment the high-resolution aerial photography is used to provide a digital orthophoto quadrangle (DOQ) for use in the computer implementation process. The digital orthophoto quadrangle is a computer-generated image of an aerial photograph wherein image displacement caused by terrain relief and camera tilt angles has been removed. Such an orthophoto or orthoimage affords the image characteristics of a photograph with the geometric qualities of a map. DOQs are produced by the USGS with 1-meter ground resolution and coverage of nearly all of the lower 48 states. The USGS has also produced DOQs with resolution of approximately ⅓ meter or one foot over about 100 of the United States most populated metropolitan areas. New York State generates its own DOQs with one foot resolution. References: www.usgs.gov, www.terraserver-usa.com, www.nysgis.state.ny.us.

Image processing algorithms and tools may be applied to the orthoimagry to facilitate or automate the location of track segments and switch machines. Algorithms such as edge detection, boundary extraction, morphological processing, template matching and area correlation are well-known to those skilled in the art of image processing and could be applied to the task of track digitization.

In a similar manner and in order to digitize a track segment, the program allows the user to define and digitize a region boundary illustrated at step 30. In one exemplary embodiment, the boundary is a closed polygon, and all of the coordinates inside the polygon belong to that region (see also regions 130 in FIG. 6). This feature allows the database to determine that a locomotive is "in the east inspection yard" for example. Multiple boundaries may be employed and the multiple boundaries may be disjoint from, overlap with or fully contain other boundaries.

Aerial photography images from USGS are tagged with geospatial reference coordinates or datum (i.e. latitude and longitude) to allow transformation of image coordinates (i.e. pixels) to geospatial coordinates. The image's geospatial reference coordinates may be in error by tens of feet, making them insufficient for rail-accurate location. To mitigate the effect of image geospatial reference errors and in accordance with an exemplary embodiment of the present invention survey grade GPS equipment is disposed in the rail yard to accurately locate a small number of specific sites which are visible in the aerial photography images. As used herein "survey grade GPS equipment" is intended to cover GPS equipment that is accurate to a centimeter level (e.g., a survey grade GPS is used to establish a known point and thereafter total station laser instruments are used to lay out measurements for other positions in the vicinity of the known point). Thereafter, survey grade GPS signals from the rail specific sites are used to correct or make the geospatial reference coordinates suitable for use with GPS signals received from assets within the rail yard. In other words, the survey grade GPS signals from the rail specific sites are used to correct the geospatial reference coordinates of the aerial photograph. Alternatively, differential GPS techniques are employed to correct the geospatial reference coordinates of the aerial photograph.

In one exemplary embodiment and as illustrated at box 32, the GPS equipment is used to locate the center of a throw bar mechanism on manually thrown switches. The manual switch machine is frequently clearly visible in the aerial photographs. Accordingly, survey grade GPS coordinates are provided for the center of the throw bar switches within the aerial photograph (e.g., multiple locations). In accordance with an exemplary embodiment, collection of GPS position data is performed at specific sites spaced widely about the rail yard. The set of measured data from these sites represent a very small portion of the whole rail yard infrastructure. Thus, the high cost and complexity of surveying the entire rail yard track network is abated by measuring a limited set of sites with a highly accurate, survey grade GPS receiver system. The set of measured geospatial data points is compared to the digitized geospatial data at the same sites to create a means for correcting the digitized geospatial data. A geometric transformation is then defined which maps the digitized data points to the measured data points in a manner which minimizes the error among all points (i.e. least squares). Common examples of geometric transformations are translation, scaling, rotation, skew and reflection. Those skilled in the art will recognize that all of these examples are represented, in general, as an affine transformation. Once determined, this geometric transformation is applied to all elements within the database to improve the alignment and reduce geospatial errors.

At step 34 the program overlays the survey GPS site locations of the reference switches on top of the rail yard imagery. Placement of the overlays is done using the approximate latitude and longitude information from the image source. At each site, or point, where a survey GPS datum exists and where a switch machine (as mentioned above) is clearly visible in the image, the user at step 36 carefully digitizes the point on the image which the reference GPS should correspond. When this is done to all applicable points, the program runs a least squares fit to determine the geometric transformation matrix which transforms the digitized points (e.g., track segments and switches) into the survey latitude/longitude points. Each digitized point is then transformed by this matrix and the difference between the transform generated latitude/longitude coordinates and the survey GPS generated latitude/longitude coordinates is the set of transform errors. The root mean square (RMS) error is calculated from this error set at decision node 38. If the RMS error is less than two feet, then the image database is accurately located. If not, the steps represented by boxes 32-38 are repeated until the desired RMS error is achieved, of course, RMS errors greater or less than two feet are also contemplated to be within the scope of exemplary embodiments of the present invention. As an example, the steps repeated by boxes 32-38 would be to incorporate additional GPS reference points wherein the data obtained at these points is survey grade GPS data. By using the RMS error calculation the end user is provided with standard deviation to determine how accurate the track layout is.

In addition and in accordance with an exemplary embodiment, sections of the rail yard tracks or areas will be defined in the database according to rail yard name designations or processing steps associated with these track or tracks. Non-limiting examples of these processing steps include train arrival; classification of rail cars; locomotive service; rail car repair; rail car inspection and non-limiting name designators include: run-through service area track 1, receiving yard track 55, classification yard track 39, departure yard track 89, storage and receiving yard overflow track 53, receiving yard track 81, locomotive parking track 99, etc. This is shown as step 40. Accordingly, the database now comprises name designators and processing steps associated with specific track segments wherein this information will be used to provide a graphical indication of the area and task being performed by an asset by merely receiving the GPS coordinates of the asset (e.g., asset coordinates place it in a location for example the classification yard thus, a graphical display can in this instance, provide the following text: "Engine X in classification yard performing . . . ").

Figure 2:
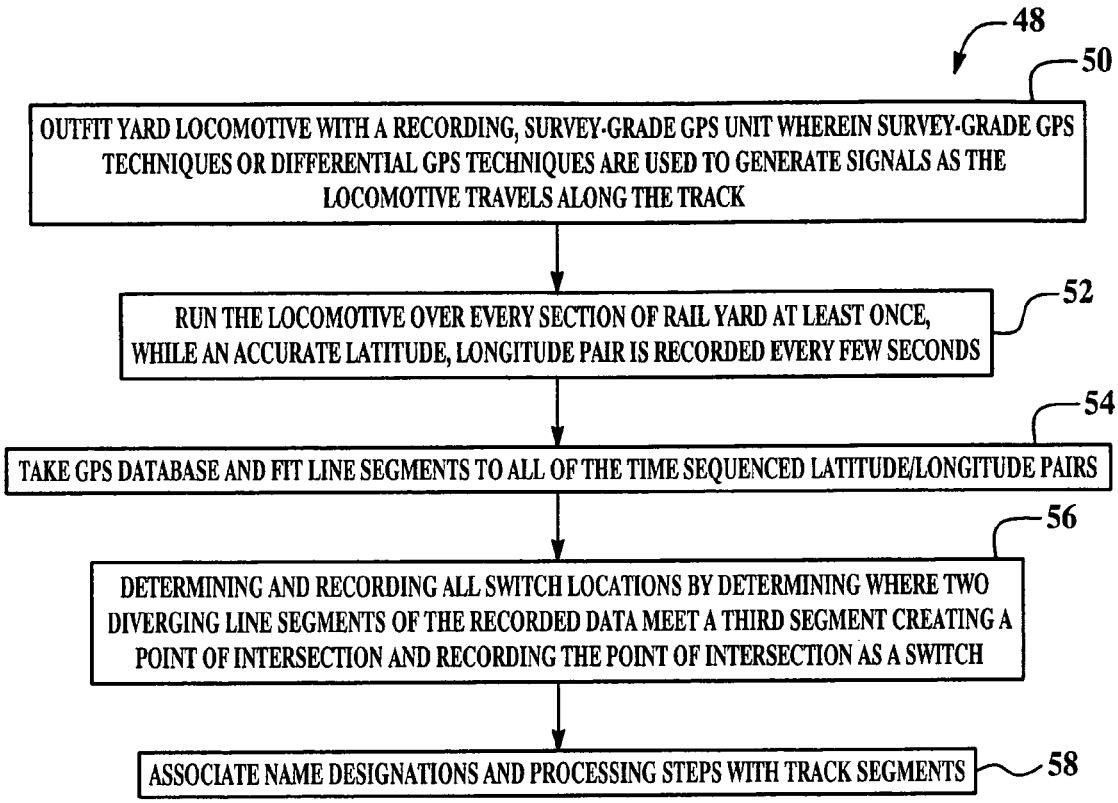
FIG. 2 is a schematic illustration of a method for generating a rail yard track database in accordance with an alternative exemplary embodiment of the present invention.

Referring now to FIG. 2 and in an exemplary embodiment and when aerial photographs of sufficient quality are not available, a yard locomotive is outfitted with a recording, survey-grade GPS unit (illustrated by box 50) wherein survey-grade GPS techniques such as Real Time Kinematic GPS (RTK GPS) are used for this effort. In this embodiment, the receiving antenna is located above the center of the track, as near as possible to the pivot axis of the front or rear truck of the locomotive. This outfitted locomotive is then run over every section of rail in the rail yard at least once, while an accurate latitude, longitude pair is recorded every few seconds (box 52). Alternatively, differential GPS systems may be employed to provide the same degree of accuracy.

Thereafter, a program at box 54 takes this GPS database and fits line segments to all of the time sequenced latitude/longitude pairs. Where two diverging line segments meet a third segment, the point of intersection is a switch, and all switch locations are recorded. This is illustrated by box 56 wherein all connected lines between switches become track segments. Connectivity of tracks and switches, and classification of switch track segments as Incoming, Outgoing Main and Outgoing Diverted are performed as above in the aerial photography embodiment. In addition, and in either embodiment each of the rail tracks in the database can be provided with name designators, wherein the name designators match those used by the field personnel of the rail yard as well as the processing steps associated therewith. Thus, when an individual (Carman) calls in from a radio and mentions a problem on track "NAME" the central control unit may be used to call up a visual presentation of the that track or specific segment or specific area of the rail yard.

In addition and as with the aerial photography embodiment, sections of the rail yard tracks or areas will be defined in the database according to rail yard name designations or processing steps associated with these track or tracks. This is shown as step 58. Accordingly, the database now comprises name designators and processing steps associated with specific track segments wherein this information will be used to provide a graphical indication of the area and task being performed by an asset by merely receiving the GPS coordinates of the asset.

Figure 3:
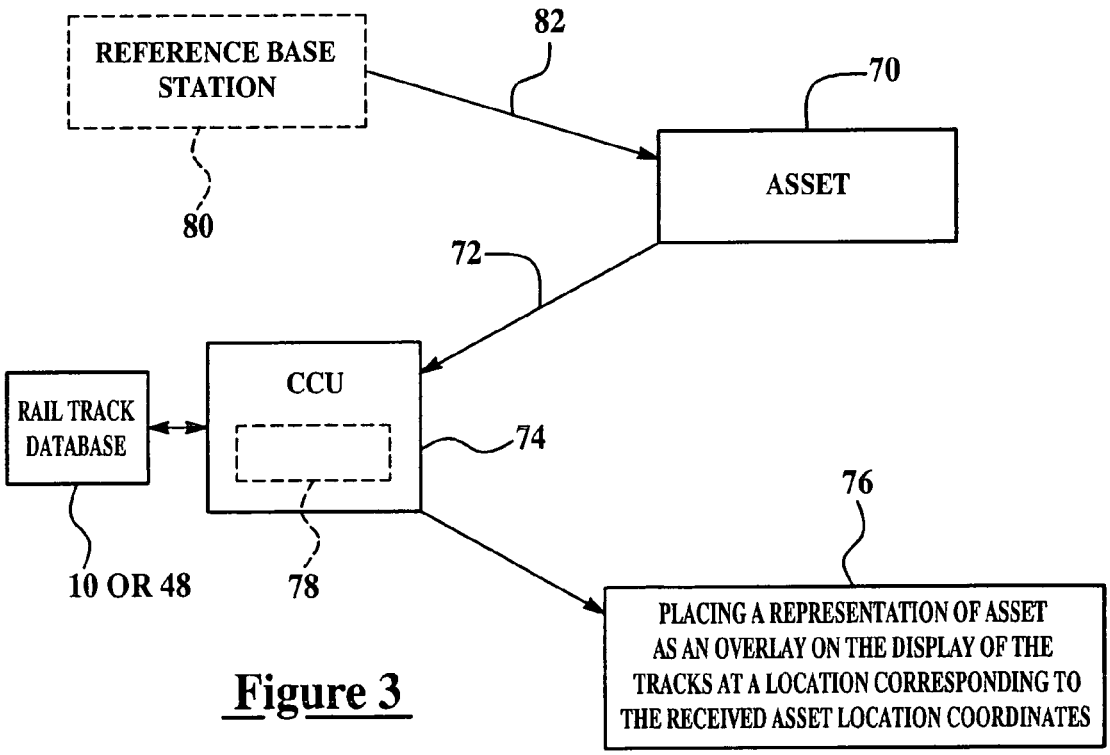
FIG. 3 is a schematic illustration of an exemplary embodiment of the present invention.

A rail track database is now available for use by the central control unit or computer 74 and in accordance with an exemplary embodiment and referring now to FIG. 3 an implementation of a track database in accordance with an exemplary embodiment of the present invention is illustrated. As used herein, the track database refers to the database constructed in accordance with exemplary embodiments of the present invention (e.g., aerial photography digitized to latitude and longitudinal coordinates with corrections or a database compiled solely from GPS signals received by a vehicle as it traverses the rail yard tracks). The database will comprise machine readable data corresponding to the location of all track segments within the rail yard. In addition, the database will also comprise rail yard processing steps associated with each portion of the track layout. These rail processing steps describe the various operations and jobs which may occur on that section of track or about a switch machine. In one embodiment, rail yard assets are associated with specific processing steps, wherein the association of the rail yards assets is based upon a tracking history of the rail yard assets. Such an embodiment utilizes stored, historical data of the asset's location and the possible job functions at each previous location. In accordance with an exemplary embodiment a rail yard asset is equipped with some means of determining its location, such as GPS reception by a GPS receiver as well as a means for transmitting the signal to the central control unit. Alternative location means in which the asset's location is determined remotely using information transmitted from or collected by the asset may also be used. Examples of such alternative location systems include so-called Real-Time Locations Systems (RTLS) such as those offered by companies including WhereNet, Ekahau and AeroScout. These RTLS solutions are accurate to approximately 10 feet to 10 meters. The location determination has some amount of error.

The asset illustrated by box 70 transmits its location information in real time via a signal 72 to a central control unit 74. It is, of course, understood that signal 72 may be transferred via a plurality of transponders, receivers, transmitters etc. disposed between the transmitter of the asset and a receiving antenna of the central control unit. Alternatively, the signal is transmitted directly to a receiver of the central control unit or both methods are employed. As used herein "real time" is intended to cover immediate or within a predetermined time period such that the signal is received in a sufficient amount of time for presentation and observation via the graphical display such that a rail yard manager may use this information to determine, which asset is most logically or most economically suited for a particular task. One non-limiting time period is less than two minutes. Of course and as applications require, periods greater or less than two minutes may be used with exemplary embodiments of the present invention.

In an alternative exemplary embodiment, the asset itself is tracked by a tracking system employing a network of: AEI readers; computer interpreted video signals, or equivalents thereof wherein a geographical position signal of the asset is obtained and transmitted to the central control unit. Thus, the signal does not come directly from the asset as the asset itself is tracked. A non-limiting example of one such system is described in U.S. Pat. No. 6,637,703, the contents of which are incorporated herein by reference thereto. In this embodiment, the signal would need to be converted to be comparable to the machine readable data of the track database wherein a graphical representation would be provided in accordance with exemplary embodiments of the present invention.

By comparing the received signal to the track database the central control unit can then provide a spatial representation of the asset relative to the rail yard tracks by placing a representation of this asset as an overlay on the display of the tracks and switches of the database at a location corresponding to the received asset location coordinates. This display representation also conveys the yard process step being performed by the asset. The yard process step represents the active task in which the asset is engaged and may be shown as a listing of all yard process steps associated with the track at the asset's location or as a single yard process step based on historical data of the asset's previous and current locations. This display is illustrated schematically by block 76, which in an exemplary embodiment comprises a graphical display on a computer monitor showing the asset, its location and the tasks being performed, wherein the task being performed can be determined by accessing data corresponding to tasks previously performed at that segment of track, or the history of the tasks performed by this asset.

Because there may be some error in the location coordinates, the resulting display may not be exact (e.g., usage of non-survey grade GPS equipment or RTLS location systems, wherein there standard of error may be on the order of feet). In the case of using non-survey grade GPS equipment for location of the asset, this error may be as much as 20 or 30 feet, but is usually 5 to 10 feet. Where railroad tracks are close together (13.25 feet), the placement error may be one or even two tracks from the correct location.

However, if the asset being tracked is a locomotive, then there is an additional constraint in the received data that the correct location of the asset always corresponds to a railroad track. Accordingly, a computer program of the central control unit uses past tracking information, which is stored in a database 78 (illustrated schematically) of that particular asset wherein the GPS data and associated tasks of past tracking information is used to determine which track the locomotive is on as well as what yard process steps it may typically be associated with as described herein associated tasks as well as track name designations are initially inputted manually to the database during in its creation and thereafter updated as the yard engine performs tasks (e.g., history), which is inputted by yard personnel. Thus, the database is updated and a history for the asset is created. The program then corrects for this error in the GPS data and places the representation of the locomotive on the correct rail, at the point closest to the reported location (again illustrated schematically as box 76).

In accordance with an exemplary embodiment and in order to provide more accurate position data from assets, differential pseudorange corrections may also be provided to the individual GPS receiver units. This differential GPS (DGPS) approach provides improved accuracy over standard GPS. Differential corrections may be obtained from the Nationwide DGPS network operated by the United States Coast Guard, from a reference base station installed at the rail yard (illustrated schematically as box 80), from commercial providers, via the Internet, or from the Federal Aviation Association's WAAS satellite system. Differential corrections are transmitted (arrow 82) to each of the mobile assets using radio links, such as 802.11b wireless local area networks. The same radio network is used to collect GPS position estimates from each node at the central control room.

Thus, corrections of the GPS asset data can be implemented by one of both of the aforementioned processes. In accordance with an exemplary embodiment, the display of assets relative to the track database may also be overlaid upon the aerial photographs of the rail yard (e.g., the aerial photograph is displayed on a screen or monitor and movement of the asset along the track is illustrated). In this embodiment, multiple user-interface displays, accessing the common database are possible where each interface is controlled by different rail yard operators. In addition, a metric relating to the confidence in correct track association is provided to the end-user. Such a metric could be based on the ratio of standard deviation in location estimate to track spacing. An alternate metric could be based on the normalized deviance between a set of filtered location positions and the associated track.

Figure 4:
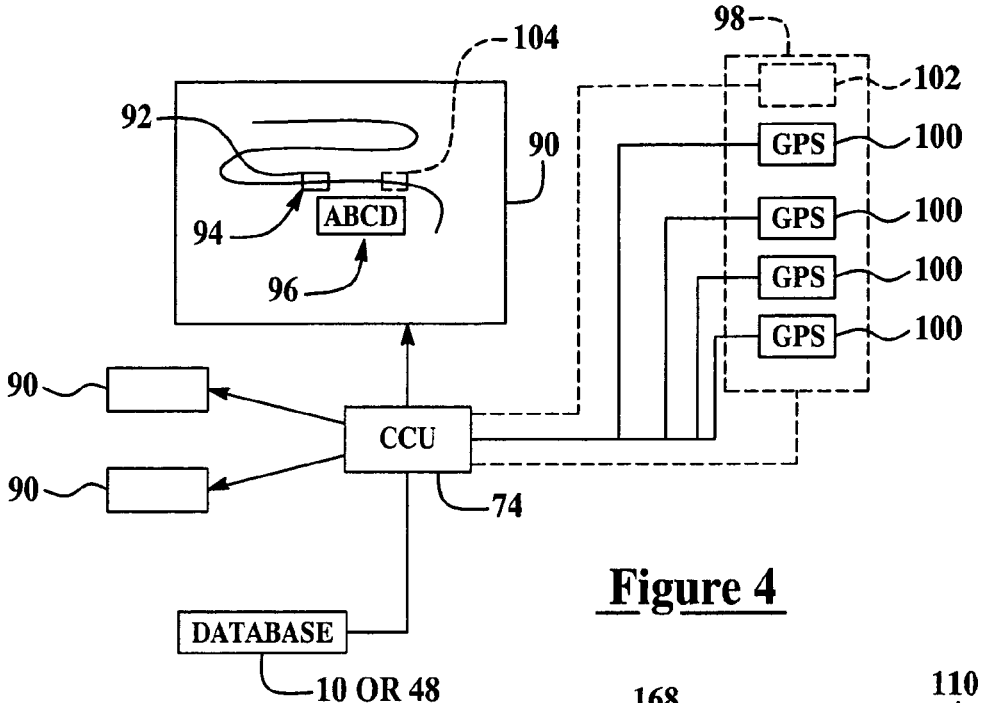
FIG. 4 is a schematic illustration of an exemplary embodiment of the present invention.

Referring now to FIG. 4, a schematic illustration of a display 90 showing a rail yard associated asset 92 its location 94 and its active yard process step 96 is provided. The active yard process step may be displayed as a text string or as a representative icon or color. Also shown are multiple displays, which may show other locations of the rail yard (i.e., smaller images of the rail yard) or may represent displays at different control locations within the rail yard. In accordance with an exemplary embodiment, the central control unit has access to the rail yard database (e.g., either compiled from aerial photography or GPS data) and a wireless network 98 is used to capture the real time GPS position information from GPS devices 100 located on rail yard assets. In one exemplary embodiment, the network may be a local area network set up within the confines of rail yard. In addition, and in an alternative exemplary embodiment the network can also be extended to capture input from rail car inspectors (i.e. Carmen) using handheld computer terminals with wireless network interfaces (illustrated schematically as box 102).

In accordance with an exemplary embodiment, and during rail car inspection, a Carmen may identify rail cars in need of repair. These so-called "bad order" cars can be identified and their location reported by the Carmen. The Carmen may use handheld computer terminals with GPS and wireless network interfaces to locate the bad order car. Again, this is illustrated by box 102. This location is conveyed to the central database system and displayed for yard operations. Such an asset is identified as an "associated" asset because it cannot move on its own, but is associated with an engine as it moves throughout the rail yard. Moreover, such an asset may not have a GPS device thus, and in this case, the Carmen may identify the associated asset as being for example, four cars away from the locomotive pulling the asset within the rail yard. Thus, we know the approximate distance of four car lengths and the display system can be configured to place an indicator approximately four car lengths away from the moving indicator of the locomotive asset and therefore as the location of the asset moves so does the indicator of the associated asset at its predetermined distance away from the locomotive. A non-limiting example of an associated asset 104 is illustrated on the display. Accordingly, real time track of a non-locomotive asset is provided.

Other associated assets of interest include refrigerator cars, cars carrying hazardous material, cars carrying high-value items, cars deemed to be related to national security, or cars which have dwelled in the car for some amount of time (i.e. "late" cars). These cars could be manually identified by Carmen or could be recognized by AEI readers (e.g., locating an AEI reader on the car itself). Their location relative to the engine or other rail cars is conveyed by the Carmen or by the AEI reader data to the control database for display to rail yard personnel.

Referring now to FIG. 5, a non-limiting graphical presentation of a track layout database 108 compiled in accordance with an exemplary embodiment is illustrated. As illustrated, a plurality of track segments 110 and switches 112 are shown. The rail yard is defined by a boundary 114 and an asset (rail yard locomotive) 92 is shown graphically, wherein the position of the asset is determined by receiving GPS data and comparing it to a database of data corresponding to the rail yard track in order to provide the graphical representation. In addition, and as previously mentioned a graphical indication of the associated task being performed is provided by another representation 96, which could in this example provide text indication that "yard locomotive X" is trimming rail cars in the classification yard. Also shown is a reference base station 80, which may or may not be in the rail yard and a yard headquarters 115 wherein the central control unit or units and the receivers/transmitters are positioned to receive signals from the GPS units on the assets traveling through the yard.

Figure 6:
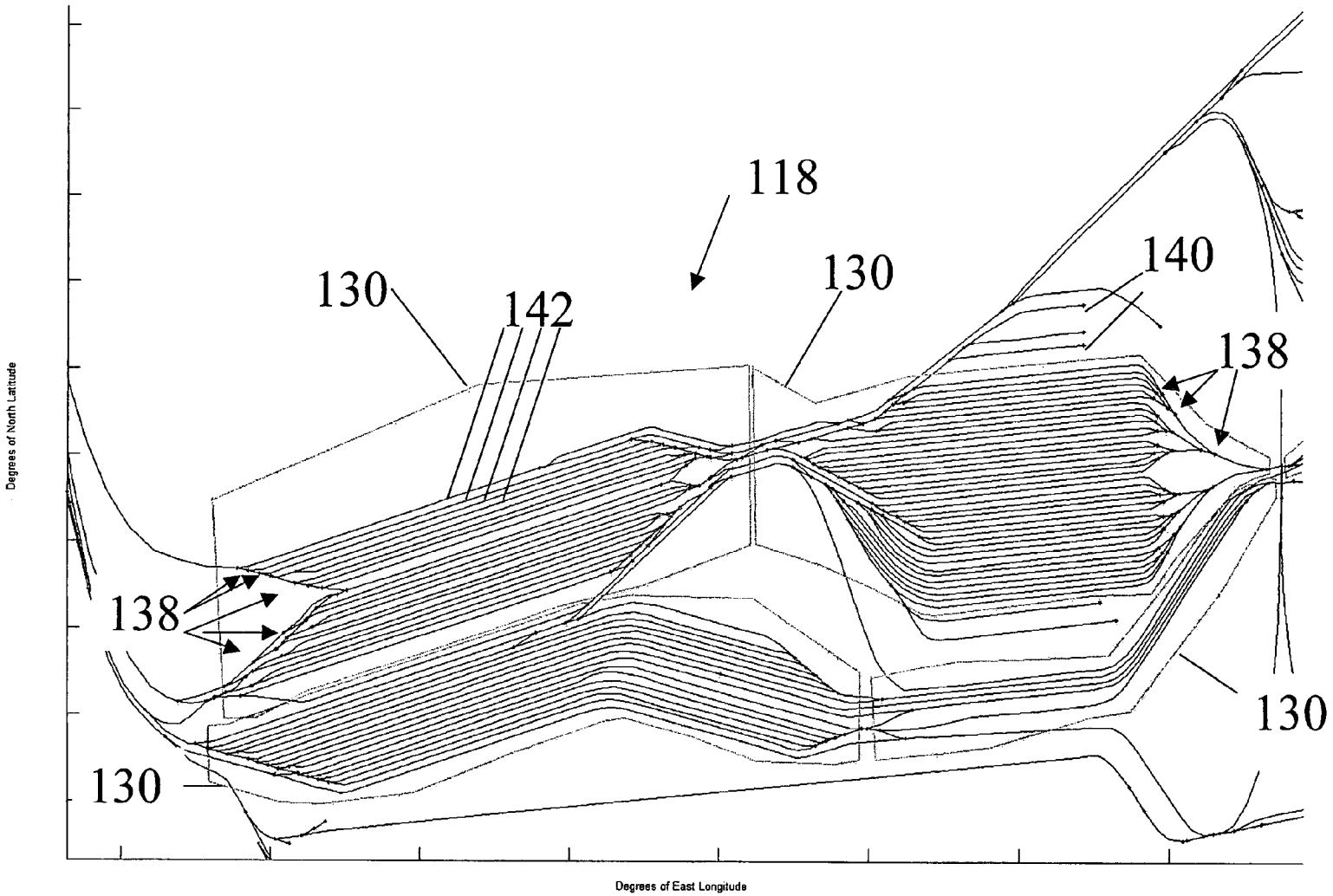
FIG. 6 is a graphical representation of a database compiled in accordance with an exemplary embodiment of the present invention.

Referring now to FIG. 6, another non-limiting graphical presentation 118 of a track layout database compiled in accordance with an exemplary embodiment is illustrated. Here the graphical representation was created from aerial photographs and as discussed herein the user digitizes all switches and track segments in the rail yard. As illustrated, regions 130 are defined and switches are digitized as a single point 138, and are represented on the display image overlay by a diamond symbol or any other equivalent symbol centered on the switch location and the endpoints 140 of all track segments 142 are associated with the closest switch in the database. Each track segment 142 is then connected to two switches, and each switch is connected to one, two or three track segments.

Thereafter, a program takes this set of digitized tracks and switches and performs step 24 of FIG. 1. A non-limiting example of some database information and/or computer code is provided below:

| | |
|---|---|
| Track segments | track(n). |
| x(m) | path position in East longitude (negative in the USA) increasing going east |
| y(m) | path position in North latitude increasing going north |
| sw1 | index of switch at start of path (track(n).x(1), track(n).y(1)) (0 if not yet |
| assigned) | |
| sw2 | index of switch at end of path (track(n).x(end), track(n).y(end)) (0 if not yet |
| assigned) | |
| name | any special yard designation for this track segment |
| lng | length of this track segment in quarter meters (useful during image overlay) |
| Swtchs | a useful vector equal to [sw1 sw2] |

Example:
track(2).x: [−50.7566 −50.7563 −50.7559 −50.7490 −50.7488 −50.7484]
track(2).y: [27.7685 27.7685 27.7686 27.7687 27.7687 27.7686]
track(2).sw1: 2
track(2).sw2: 3
track(2).name: 'East Class 17'
track(2).lng: 2.7233e+003 (note: this is 681 meters or 2234 feet)
track(2).swtchs: [2 3]

| | |
|---|---|
| Switches | swtch(i). |
| x | position in East longitude (negative in the USA) increasing going east |
| y | position in North latitude increasing going north |
| tracks(3) | 3 integers, main in, main out, divert out track segment indices |
| name | any special yard designation for this switch |

Example:
swtch(2).x: −50.7566
swtch(2).y: 27.7685
swtch(2).name: "
swtch(2).tracks: [4 3 2]

| | |
|---|---|
| Boundaries | bound(j). |
| x(m) | boundary path position in East longitude (negative in the USA) |
| increasing going east | |
| y(m) | boundary path position in North latitude increasing going north |
| name | any special yard designation for this bounded area |

Example:
bound(2).x: [−50.7969 −50.7965 −50.7954 −50.7938 −50.7897 −50.7853 −50.7826
...]
bound(2).y: [27.7678 27.7665 27.7665 27.7666 27.7669 27.7671 27.7672
...]
bound(2).name: 'West Departure Yard'

Accordingly, a technical effect or effects of exemplary embodiments of the present invention provide a means of creating, correcting and using an accurate database of track locations in a rail yard from either aerial photography or Global Position System (GPS) data acquisition, wherein the database is located in a control room of a rail yard wherein a computer or controller of the system receives data from an asset within the rail yard. The data of the asset is GPS data comprising coordinates comparable to the coordinates of the database and the computer compares the asset coordinates to the track database and thereafter a visual display of the asset is provided. Moreover, exemplary embodiments of the present invention use this information to locate the asset to a particular track or area of the rail yard to identify the current activity of the asset given yard process steps associated with that track or area of the rail yard and the display will also include a graphical representation of the yard area or track designation and the yard processing steps performed there or previously performed by the asset (e.g., a yard locomotive). Accordingly, exemplary embodiments of the present invention allow for fast, simple and low cost methods of creating an accurate track location database for a rail yard.

As described above, algorithms for implementing exemplary embodiments of the present invention can be embodied in the form of computer-implemented processes and apparatuses for practicing those processes. The algorithms can also be embodied in the form of computer program code containing instructions embodied in tangible media, such as floppy diskettes, CD-ROMs, hard drives, or any other computer-readable storage medium, wherein, when the computer program code is loaded into and executed by a computer and/or controller, the computer becomes an apparatus for practicing the invention. Existing systems having reprogrammable storage (e.g., flash memory) that can be updated to implement various aspects of command code, the algorithms can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer. When implemented on a general-purpose microprocessor, the computer program code segments configure the microprocessor to create specific logic circuits.

These instructions may reside, for example, in RAM of the computer or controller. Alternatively, the instructions may be contained on a data storage device with a computer readable medium, such as a computer diskette. Or, the instructions may be stored on a magnetic tape, conventional hard disk drive, electronic read-only memory, optical storage device, or other appropriate data storage device. In an illustrative embodiment of the invention, the computer-executable instructions may be lines of compiled C++ compatible code.

In accordance with exemplary embodiments of the present invention the central control unit may be of any type of controller and/or equivalent device comprising among other elements a microprocessor, read only memory in the form of an electronic storage medium for executable programs or algorithms and calibration values or constants, random access memory and data buses for allowing the necessary communications (e.g., input, output and within the microprocessor) in accordance with known technologies. It is understood that the processing of the above description may be implemented by a controller operating in response to a computer program. In order to perform the prescribed functions and desired processing, as well as the computations therefore, the controller may include, but not be limited to, a processor(s), computer(s), memory, storage, register(s), timing, interrupt(s), communication interfaces, and input/output signal interfaces, as well as combinations comprising at least one of the foregoing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for tracking assets within a rail yard, the method comprising:

creating a track layout database for the rail yard on a machine readable storage medium, the track layout database providing a map of rail tracks and switches within the rail yard, wherein the track layout database includes machine readable data identifying discrete locations of the rail tracks and switches of the rail yard, each discrete location corresponding to a geographical position of a portion of a rail track or switch;

associating rail yard processing steps with portions of the, track layout database;

receiving a geographical position signal corresponding to a location of an asset within the rail yard;

comparing the geographical position signal to the machine readable data of the track layout database in order to identify the location of the asset within the map; and displaying on a computer monitor, the map with a graphical presentation of the location of the asset and an indication as to the rail yard processing steps conducted on the track occupied by the asset, wherein the geographical position signal is received within a time period to allow the graphical presentation to be used in a management decision corresponding to the asset.

2. The method as in claim 1, wherein the step of creating the track layout database further comprises using aerial photography to provide a photographical image of the rail tracks and switches, wherein the discrete locations of the rail tracks and switches are created by selecting points on the photographical image to create the machine readable data using image processing algorithms, wherein the image processing algorithms cause the track layout database to have digitized machine readable data corresponding to the aerial photography of the rail yard.

3. The method as in claim 2, wherein the photographical image is a digital orthophoto quadrangle (DOQ) image or a computer-generated image of an aerial photograph wherein image displacement caused by terrain relief and camera tilt angles has been removed and a rail track segment is defined by connecting two of the selected points along a rail track segment and a selected switch position is further defined as including an end point of a rail track segment.

4. The method as in claim 2, wherein the step of creating the track layout database further comprises:

selecting one or more specific sites within the rail yard which are also visible in the aerial photographs used to construct the track layout database;

collecting geospatial position data for each specific site using signals received from at least one global positioning system receiver, the geospatial position data being generated at each specific site via the at least one global positioning system receiver;

comparing the collected geospatial position data for each site with a corresponding digitized geospatial position of each site, the corresponding digitized geospatial position being obtained from the digitized machined readable data corresponding to the aerial photography of the rail yard;

defining a geometric transformation for the collected geospatial position data and the corresponding digitized geospatial position data in order to minimize errors between the collected geospatial position data for each site and the corresponding digitized geospatial position of each site; and applying the geometric transformation to the track layout database.

5. The method as in claim 4, wherein the one or more specific sites correspond to manual switch throw machines located along the rail tracks.

6. The method as in claim 4 wherein the at least one global positioning system receiver is a survey grade global position system receiver and the geometric transformation minimizes the errors between the collected geospatial position data for each site and the corresponding digitized geospatial position of each site via a least square error criteria.

7. The method as in claim 1, wherein the rail yard processing steps include: train arrival; classification of rail cars; locomotive service; rail car repair; rail car inspection, and wherein the time period is less than two minutes.

8. The method as in claim 1, further comprising:

creating a data tracking history for the asset; and using the data tracking history of the asset to assign the asset to one specific rail track section and identify the rail yard processing steps performed on the track section assigned to the asset.

9. The method as in claim 1, further comprising:

creating a special status map feature to integrate information from the rail yard concerning an associated asset;

providing a geographical position of the associated asset; and presenting a graphical presentation of the associated asset on the map.

10. The method as in claim 9, wherein the information from the rail yard is provided by radio communications and the associated asset is a rail car selected from the group consisting of: bad order cars; hazmat cars; refrigerator cars; uniquely identified cars; and combinations of the foregoing.

11. The method as in claim 9, wherein the associated asset is a rail car and the information corresponds to a time when the rail car arrived in the rail yard and a time duration the rail car has been in the rail yard.

12. The method as in claim 9, wherein the information is global positioning data corresponding to the associated asset and the associated asset is not a rail car or locomotive and the graphical presentation of the associated asset locates the associated asset relative to a specific rail track within the rail yard.

13. The method as in claim 1, wherein the step of creating the track layout database further comprises:

positioning a global positioning device on a vehicle configured to travel along the tracks of the rail yard;

generating a plurality of signals corresponding to geographical positions as the vehicle traverses along the rail tracks within the rail yard; and recording the plurality of signals to provide the map of rail tracks and switches within the rail yard.

14. The method as in claim 13, wherein the vehicle travels along the tracks of the rail yard at least twice, to provide the map.

15. The method as in claim 1, further comprising:

providing name designators for the rail tracks, wherein the name designators match those used for the rail tracks at the rail yard.

16. A system for tracking assets within a rail yard, the system comprising:

a track layout database for the rail yard, the track layout database providing a map of rail tracks and switches within the rail yard, wherein the track layout database includes machine readable data identifying discrete locations of the rail tracks and switches of the rail yard, each discrete location corresponding to a geographical position of a portion of a rail track or switch;

a plurality of positioning devices configured to generate geographical position signals corresponding to locations of a plurality of assets within the rail yard; and a computer system configured to receive and compare the geographical position signals to the machine readable data of the track layout database in order to identify the locations of each of the plurality of assets within the map, and present a graphical presentation of the locations of each of the plurality of assets and the rail yard process tasks performed at each of the track locations occupied by each of the plurality of assets on the map.

17. The system as in claim 16, wherein the geographical position signals are transmitted wirelessly.

18. The system as in claim 16, wherein the track layout database is created from aerial photography of the rail yard and the discrete locations of the rail tracks and switches are created by selecting points on the map to create the machine readable data using image processing algorithms, wherein the aerial photography provides a photographical image of rail tracks and switches in the rail yard and the photographical image is a digital orthophoto quadrangle (DOQ) image or a computer-generated image of an aerial photograph wherein image displacement caused by terrain relief and camera tilt angles has been removed.

19. The system as in claim 18, wherein the track layout database is created by the method comprising:

selecting one or more specific sites within the rail yard which are also visible in the aerial photographs used to construct the track database;

collecting geospatial position data for each specific site using signals received from at least one global positioning system receiver, the geospatial position data being generated at each specific site via the at least one global positioning system receiver;

comparing the collected geospatial position data for each site with a corresponding digitized geospatial position of each site, the corresponding digitized geospatial position being obtained from the digitized machined readable data corresponding to the aerial photography of the rail yard;

defining a geometric transformation for the collected geospatial position data and the corresponding digitized geospatial position data in order to minimize errors between the collected geospatial position data for each site and the corresponding digitized geospatial position of each site; and applying the geometric transformation to the entire track layout database.

20. The system as in claim 19, wherein the geometric transformation minimizes the errors between the collected geospatial position data for each site and the corresponding digitized geospatial position of each site via a least square error criteria.

21. The system as in claim 16, wherein the track layout database is created by:

positioning a global positioning device on a vehicle configured to travel along the rail tracks of the rail yard;

generating a plurality of signals corresponding to geographical positions as the vehicle traverses along the rail tracks within the rail yard; and recording the plurality of signals to provide the map of rail tracks and switches within the rail yard.

22. The system as in claim 16, wherein the graphical presentation of the location of the plurality of assets on the map also includes a presentation of the rail yard process tasks conducted on or about the track segment occupied by each of the plurality of assets.

23. The system as in claim 16, wherein the computer system creates a data tracking history for at least one of the plurality of assets; and the computer system uses the data tracking history to assign the asset to one specific rail track.

24. The system as in claim 16, wherein the computer system communicably interfaces with a storage medium encoded with machine readable instructions for configuring the computer system to create a special status map feature to integrate information from the rail yard concerning an associated asset;

provide a geographical position of the associated asset; and present a graphical presentation of the associated asset on the map.

25. The system as in claim 24, wherein the information from the rail yard is provided by radio communications and the associated asset is a rail car selected from the group consisting of: bad order cars; hazmat cars; refrigerator cars; uniquely identified cars; and combinations of the foregoing.

26. The system as in claim 24, wherein the associated asset is a rail car and the information corresponds to the time that the rail car has arrived in the rail yard and how long the rail car has been in the rail yard.

27. The system as in claim 24, wherein the information is global positioning data corresponding to the associated asset and the associated asset is not a rail car or locomotive and the graphical presentation of the associated asset locates the associated asset relative to a specific rail track within the rail yard.

28. The system as in claim 22, wherein presenting a graphical presentation of the location of the asset on the map, wherein the geographical position signal is received within a time period to allow the graphical presentation to manage the asset, wherein the rail yard processing steps include: train arrival; classification of rail cars; locomotive service; rail car repair; rail car inspection, and wherein the time period is less than two minutes.

* * * * *

UNITED STATES PATENT AND TRADEMARK OFFICE

CERTIFICATE OF CORRECTION

PATENT NO. : 7,805,227 B2
APPLICATION NO. : 11/318338
DATED : September 28, 2010
INVENTOR(S) : Welles et al.

It is certified that error appears in the above-identified patent and that said Letters Patent is hereby corrected as shown below:

Title Page,
On Page 2, Item (56), under "OTHER PUBLICATIONS", in Column 2, Line 7, delete "al,;SICE-ICASe," and insert -- al.; SICE-ICASE, --, therefor.

Title Page,
On Page 2, Item (56), under "OTHER PUBLICATIONS", in Column 2, Line 17, delete "Zhicliang" and insert -- Zhiqiang --, therefor.

In Fig. 1, Sheet 1 of 4, for Tag "20", in Line 1, delete "OVERLY" and insert -- OVERLAY --, therefor.

In Fig. 1, Sheet 1 of 4, for Tag "34", in Line 2, delete "LATITUDE LONGITUDE" and insert -- LATITUDE AND LONGITUDE --, therefor.

In Column 1, Line 35, delete "reader." and insert -- reader, --, therefor.

In Column 14, Line 29, in Claim 1, delete "the," and insert -- the --, therefor.

Signed and Sealed this
Twenty-eighth Day of December, 2010

David J. Kappos

David J. Kappos
*Director of the United States Patent and Trademark Office*